US011278128B1

(12) United States Patent
Flannery et al.

(10) Patent No.: US 11,278,128 B1
(45) Date of Patent: Mar. 22, 2022

(54) BABY CHANGING PAD APPARATUS HAVING LOCATOR, LOCATOR RECEIVER, AND NON-SKID GRIP COMBINATION

(71) Applicant: Regalo International, LLC, Burnsville, MN (US)

(72) Inventors: Mark A. Flannery, Longboat Key, FL (US); Michael P. Lane, Chaska, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 17/067,562

(22) Filed: Oct. 9, 2020

Related U.S. Application Data

(60) Provisional application No. 62/913,151, filed on Oct. 9, 2019.

(51) Int. Cl.
*A47D 5/00* (2006.01)
*A47B 91/04* (2006.01)

(52) U.S. Cl.
CPC ..... *A47D 5/00* (2013.01); *A47B 91/04* (2013.01)

(58) Field of Classification Search
CPC ..... A47D 5/00; Y10T 24/33; A47G 2009/004
See application file for complete search history.

(56) References Cited

U.S. PATENT DOCUMENTS 5,729,221 A * 3/1998 Krolopp ..... H01H 13/84 341/22
7,832,555 B2 11/2010 Flannery
2010/0314511 A1* 12/2010 Hutter, III ..... F16B 11/006 248/205.3
2018/0106664 A1* 4/2018 Bottomly ..... A47D 5/00

FOREIGN PATENT DOCUMENTS

WO WO-0056260 A1 * 9/2000 ..... A47D 5/00

* cited by examiner

*Primary Examiner* — David R Hare
*Assistant Examiner* — Adam C Ortiz

(57) ABSTRACT

A baby changing pad apparatus having a locator, locator receiver, and non-skid grip combination for engaging the baby changing pad apparatus to a first surface. The locator receiver includes a quick connect first portion engaged to the baby changing pad apparatus. The locator includes a quick connect second portion engagable between the quick connect first portion and first surface. The non-skid grip may engage the first surface with or without the locator engaged to the locator receiver.

20 Claims, 16 Drawing Sheets

BABY CHANGING PAD APPARATUS HAVING LOCATOR, LOCATOR RECEIVER, AND NON-SKID GRIP COMBINATION

This application claims the benefit under 35 U.S.C. 119(e) of U.S. Provisional Patent Application No. 62/913,151 filed Oct. 9, 2019, which is hereby incorporated by reference in its entirety into this application.

FIELD OF THE INVENTION

The present invention relates to a baby changing pad apparatus, particularly to a baby changing pad apparatus having a locator receiver, and specifically to a baby changing pad apparatus having both of a locator receiver and non-skid grip.

BACKGROUND OF THE INVENTION

Rubber wiper blades sliding across a dry windshield are undesirable and may ruin the rubber wiper blades. Rubber wiper blades slide across a windshield easily, like mercury, in a sprinkle. Rubber wiper blades do not need a downpour to run easily across a windshield. A miniscule amount of water lowers the coefficient of friction instantaneously.

A conventional baby changing pad slides on a wet table. A conventional baby changing pad slides on a moist table. A conventional baby changing pad slides on a table having a wet spot. A baby changing pad that sticks to a table that is wet, or moist, or has a wet spot, is desirable.

SUMMARY OF THE INVENTION

A feature of the present invention is a baby changing pad apparatus.

Another feature of the present invention is the provision in a baby changing pad apparatus, of a locator.

Another feature of the present invention is the provision in a baby changing pad apparatus, of a locator receiver.

Another feature of the present invention is the provision in a baby changing pad apparatus, of a non-skid grip.

Another feature of the present invention is the provision in a baby changing pad apparatus, of a locator, locator receiver, and non-skid grip combination.

Another feature of the present invention is the provision in a baby changing pad apparatus, of the locator receiver engaged to the baby changing apparatus and including a quick connect first portion.

Another feature of the present invention is the provision in a baby changing pad apparatus, of the locator including a quick connect second portion.

Another feature of the present invention is the provision in a baby changing pad apparatus, of the locator engagable to a first surface.

Another feature of the present invention is the provision in a baby changing pad apparatus, of the baby changing pad having an underside, and of the non-skid grip engaged to the underside and facing away from the baby changing pad.

Another feature of the present invention is the provision in a baby changing pad apparatus, of the baby changing pad having an underside, and of the quick connect first portion engaged to the underside and facing away from the baby changing pad.

Another feature of the present invention is the provision in a baby changing pad apparatus, of the quick connect second portion having first and second opposing sides, where the first side is engagable to and disengagable from the quick connect first portion, and where the second side is engagable to the first surface such that the baby changing pad is engagable to the first surface.

Another feature of the present invention is the provision in a baby changing pad apparatus, of an outer surface of the non-skid grip defining a first plane, of an outer surface of the quick connect first portion defining a second plane, and of the first and second planes being generally co-planar.

Another feature of the present invention is the provision in a baby changing pad apparatus, of an outer surface of the non-skid grip defining a first plane, of an outer surface of the quick connect first portion defining a second plane, of the first and second planes being parallel to each other, and of the first and second planes being offset from each other.

Another feature of the present invention is the provision in a baby changing pad apparatus, of an outer surface of the non-skid grip defining a first plane, of an outer surface of the quick connect first portion defining a second plane, of the first and second planes being parallel to each other, and of the second plane being outwardly of the first plane.

Another feature of the present invention is the provision in a baby changing pad apparatus, of an outer surface of the non-skid grip defining a first plane, of an outer surface of the quick connect first portion defining a second plane, of the first and second planes being parallel to each other, and of the first plane being outwardly of the second plane.

Another feature of the present invention is the provision in a baby changing pad apparatus, of the non-skid grip including a rubber or rubber-like material.

Another feature of the present invention is the provision in a baby changing pad apparatus, of the non-skid grip including a material that is soft to the touch.

Another feature of the present invention is the provision in a baby changing pad apparatus, of the non-skid grip including an elastomer.

Another feature of the present invention is the provision in a baby changing pad apparatus, of the non-skid grip including a material having a high coefficient of friction on smooth wood.

Another feature of the present invention is the provision in a baby changing pad apparatus, of the non-skid grip including a material having a high coefficient of friction on a material selected from the group of materials consisting of smooth wood, smooth glass, smooth plastic, smooth tile, smooth ceramics, smooth quartz, smooth stone, smooth porcelain, smooth vinyl, smooth enamel, smooth metal, smooth iron, and smooth steel.

Another feature of the present invention is the provision in a baby changing pad apparatus, of the non-skid grip surrounding the quick connect first portion.

Another feature of the present invention is the provision in a baby changing pad apparatus, of the non-skid grip being adjacent to the quick connect first portion.

Another feature of the present invention is the provision in a baby changing pad apparatus, of the quick connect first portion being disposed centrally of the non-skid grip.

Another feature of the present invention is the provision in a baby changing pad apparatus, of one of the quick connect first and second portions including hooks and where the other of the quick connect first and second portions includes loops.

Another feature of the present invention is the provision in a baby changing pad apparatus, of the non-skid grip abutting or being adjacent to the first surface a) when the quick connect first portion is engaged to the quick connect second portion and b) when the baby changing pad apparatus is free of the quick connect second portion such that the quick connect second portion is not between the quick connect first portion and the first surface.

Another feature of the present invention is the provision in a baby changing pad apparatus, of the baby changing pad including a resilient base and a flexible cover, where the non-skid grip and quick connect first portion are engaged to the flexible cover, and where the non-skid grip and quick connect first portion are free of the resilient base.

Another feature of the present invention is the provision in a baby changing pad apparatus, of the baby changing pad including a resilient base and a flexible cover, where the non-skid grip is engaged to and abuts the flexible cover, and where the quick connect first portion is engaged to and abuts the non-skid grip.

An advantage of the present invention is that a first connection of a baby changing pad is engagable to a wet surface such as a wet table top.

Another advantage of the present invention is that a second connection of a baby changing pad, different in kind from the first connection of the baby changing pad, is engagable to a dry surface such as a dry table top.

Another advantage of the present invention is a first surface connector that operates at the same time as a second surface connector where the first and second surface connectors are different in kind.

Another advantage of the present invention is that there is double surface engagement on a table or surface in any directional movement that a child may make. For example, if a child leans toward the northeast corner of the baby changing pad there is double surface engagement at such corner. The same is true with a lean toward any of the three other corners or between any two of the corners. Leans in any of 360 degrees places pressure on one or more of the four quick connect and non-skid grip combinations, which pressure leads to a greater non-skid grip engagement and a greater quick connect engagement. Double surface engagement means an engagement of two different kinds.

Another advantage of the present invention is a baby changing pad that is simple to use.

Another advantage of the present invention is a baby changing pad that is inexpensive to manufacture.

DESCRIPTION

Figure 1:
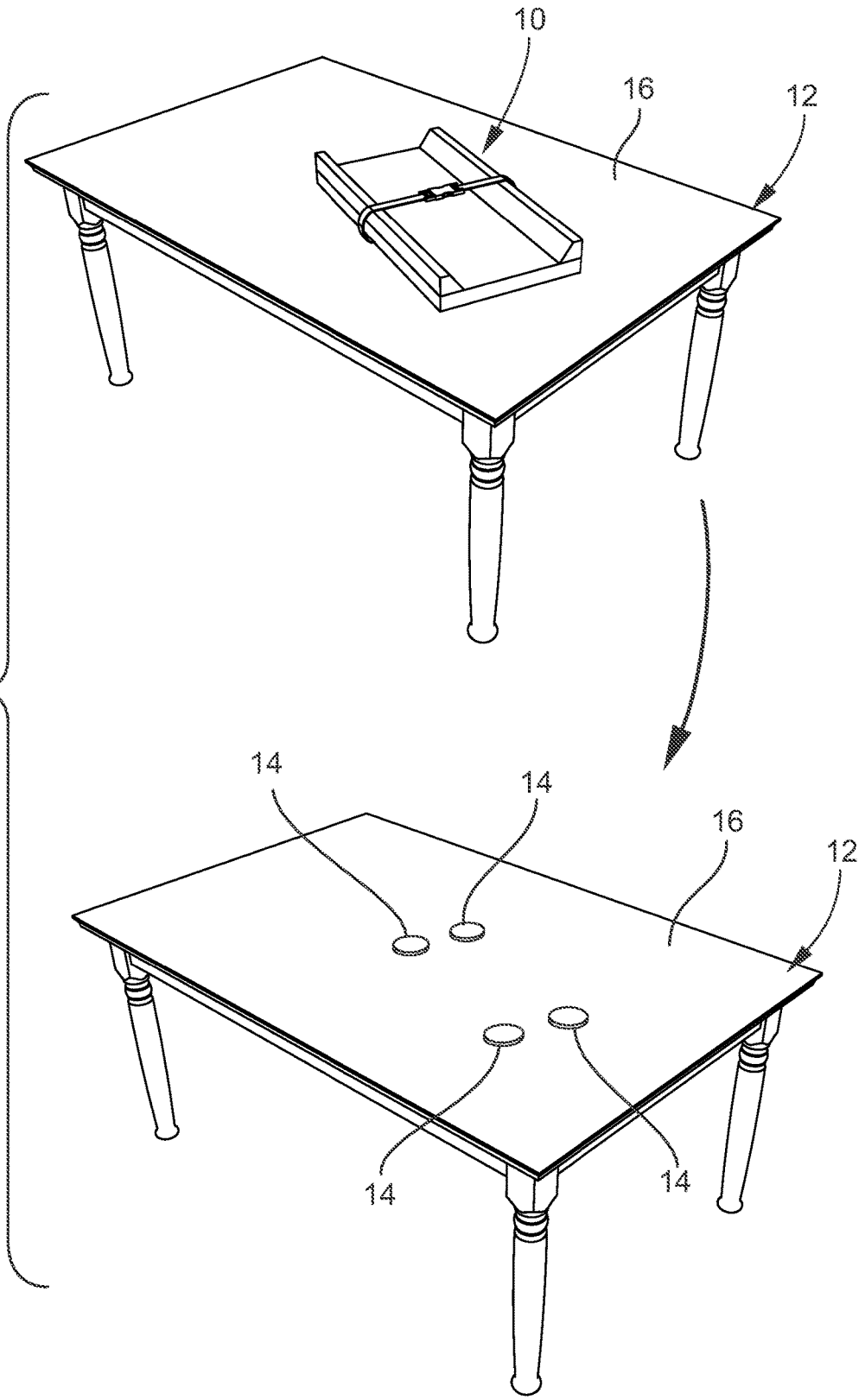
FIG. 1 is a perspective view of a first table having two states: a first state where the first table includes the present baby changing pad engaged thereto and further includes relatively permanent locators engaged thereto but hidden from view, and a second state where the first table includes no baby changing pad but still includes the relatively permanent locators engaged thereto.
Figure 2:
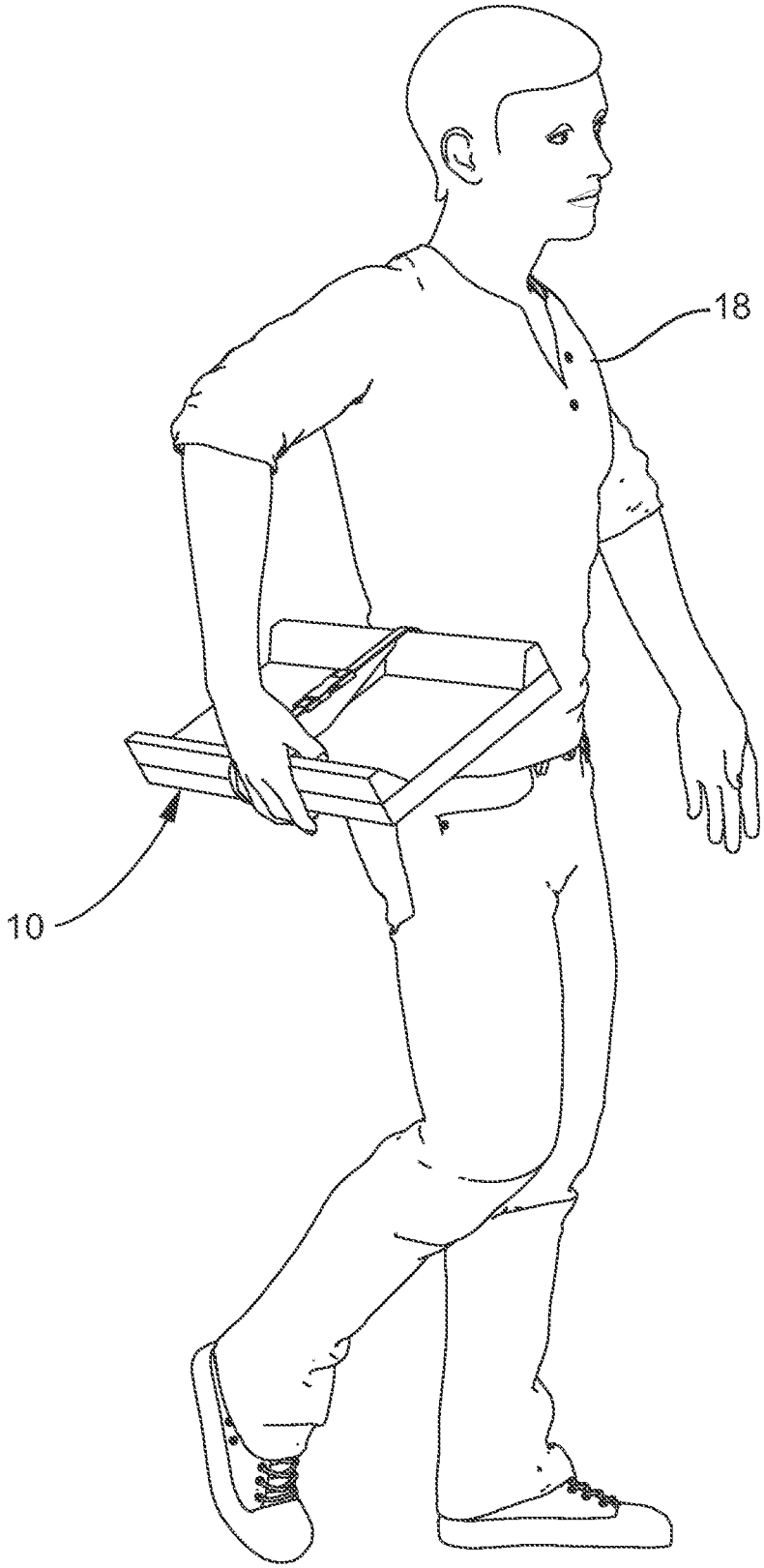
FIG. 2 is a perspective view of the caregiver that has removed the baby changing pad from the table of FIG. 1, where the caregiver is walking with the baby changing pad of FIG. 1 away from home to another destination.
Figure 3:
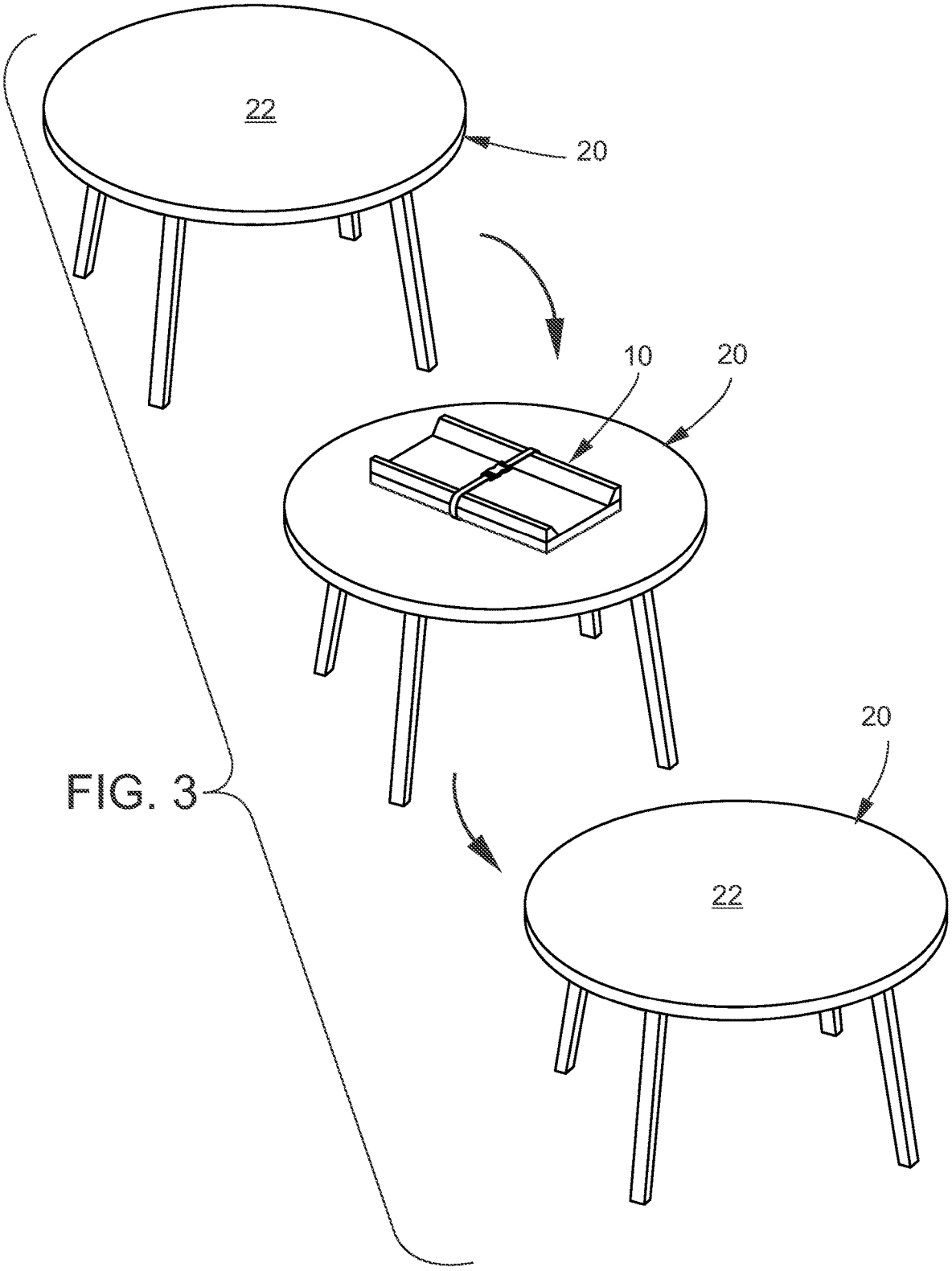
FIG. 3 is a perspective view of a second table having three states, a first state where the second table engages no baby changing pad and which is the state that the caregiver initially finds the second table, a second state where the second table engages the baby changing pad carried to the second table by the caregiver, and a third state where the second table engages no baby changing pad and that is the state in which the caregiver leaves the table.
Figure 4:
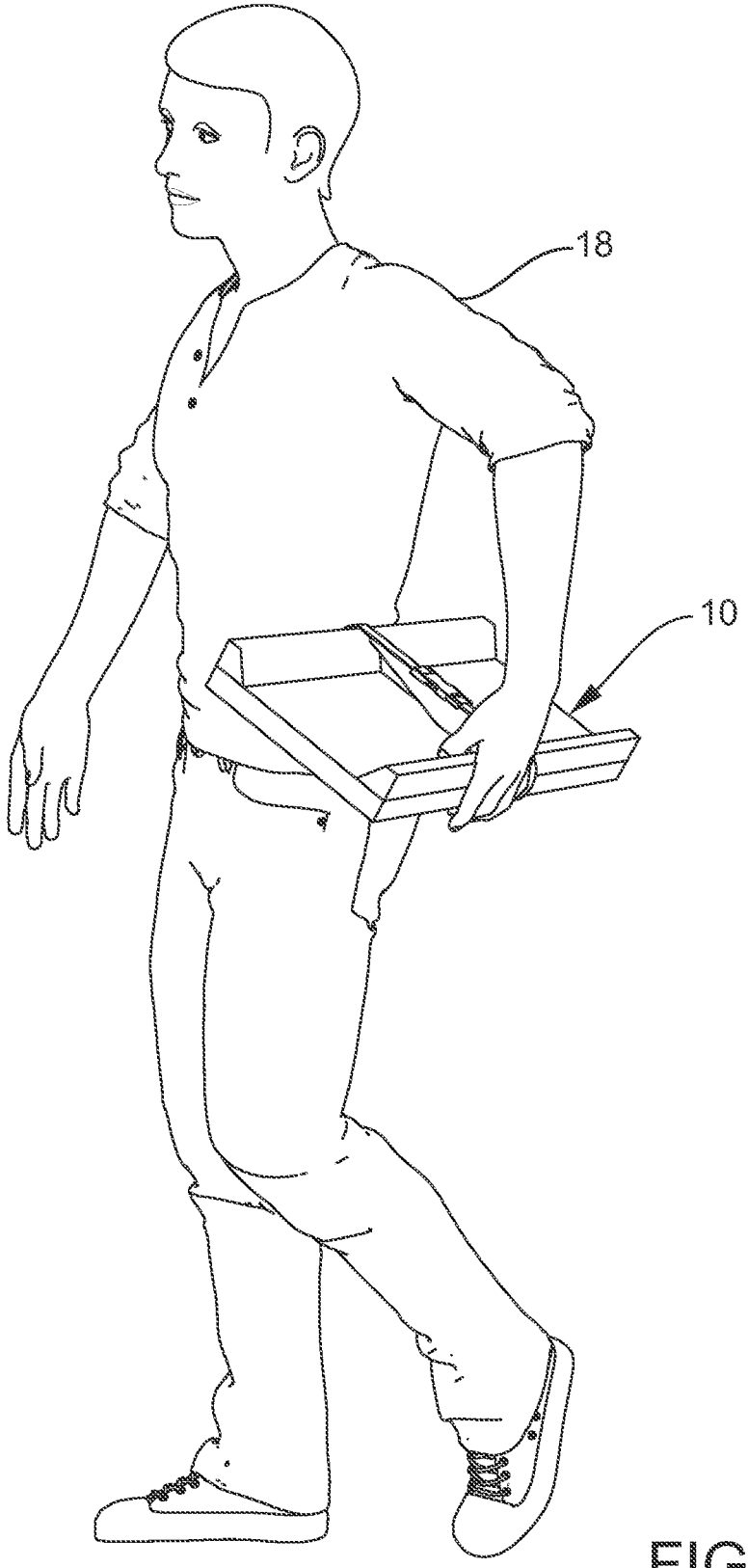
FIG. 4 is a perspective view of the caregiver that has removed the baby changing pad from the table of FIG. 3, where the caregiver is walking with the baby changing pad of FIG. 3 back home.
Figure 5:
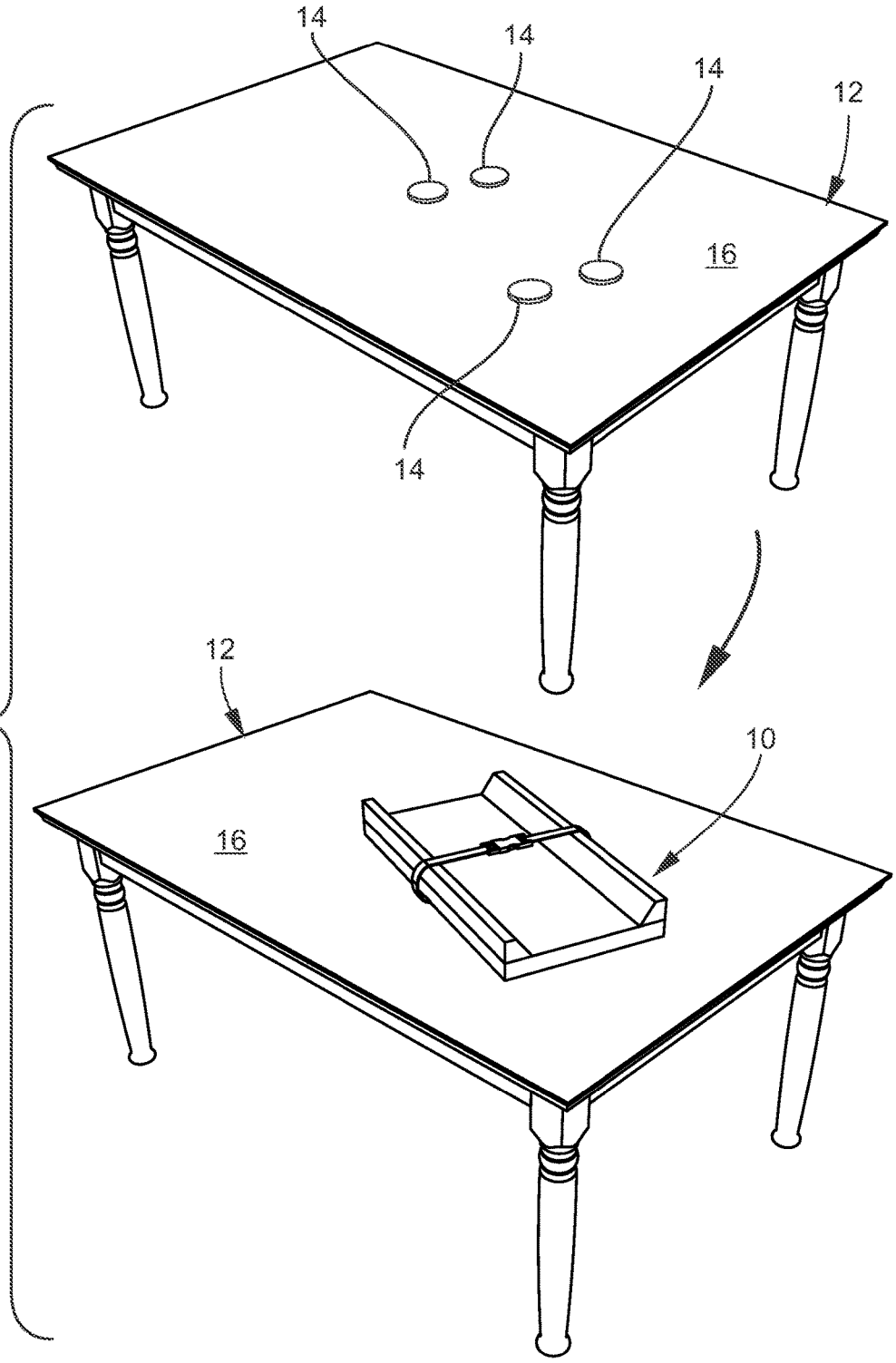
FIG. 5 is a perspective view of the first table of FIG. 1 having two states: and a first state where the first table includes no baby changing pad but includes the relatively permanent locators engaged thereto, which is the state that the caregiver finds the first table upon his return home, and a second state where the first table includes the present baby changing pad engaged thereto and further includes relatively permanent locators engaged thereto but hidden from view.

FIG. 1 shows the present baby changing pad apparatus 10 on a first table 12 and shows the baby changing pad apparatus 10 having been lifted off the first table 12 and further having been lifted off locators 14 that are engaged by adhesive to the table top 16 of the first table 12, such that the locators 14 are left behind. FIG. 2 shows the caregiver 18, who disengaged the baby changing pad apparatus 10 from the first table 10, carrying the baby changing apparatus 10 to another destination. FIG. 3 shows the caretaker's destination where a second table 20, with a table top 22, includes no locators 14 when the caregiver 18 arrives, shows that the caregiver 18 uses the baby changing pad 10 on the second table 20 with no locators 14, and shows that when the caregiver 18 leaves the second destination the second table 20 is devoid of locators 14 and thus in the same state as when the caregiver 18 arrived. FIG. 4 shows the caregiver 18 carrying the baby changing pad apparatus 10 from the second destination having table 20 back to the first destination having table 12. FIG. 5 shows that the caregiver 18 encounters the first table 12 having the locators 14 and then places the baby changing apparatus 10 on the locators 14 and first table 12.

Figure 6A:
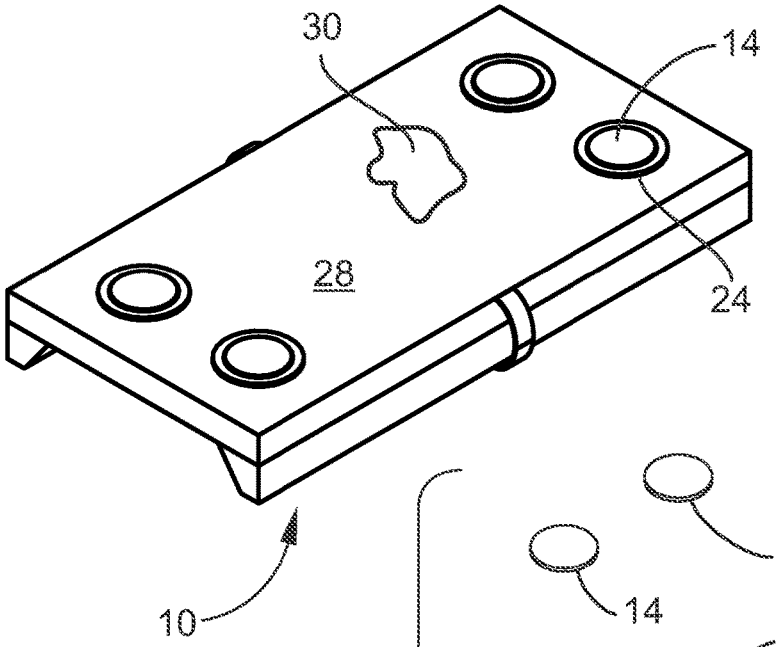
FIG. 6A is a perspective view of the baby changing pad of FIG. 1 shown in an upside down position having the locators engaged thereto, with the locators having peel off releases still engaged to the locators.
Figure 6B:
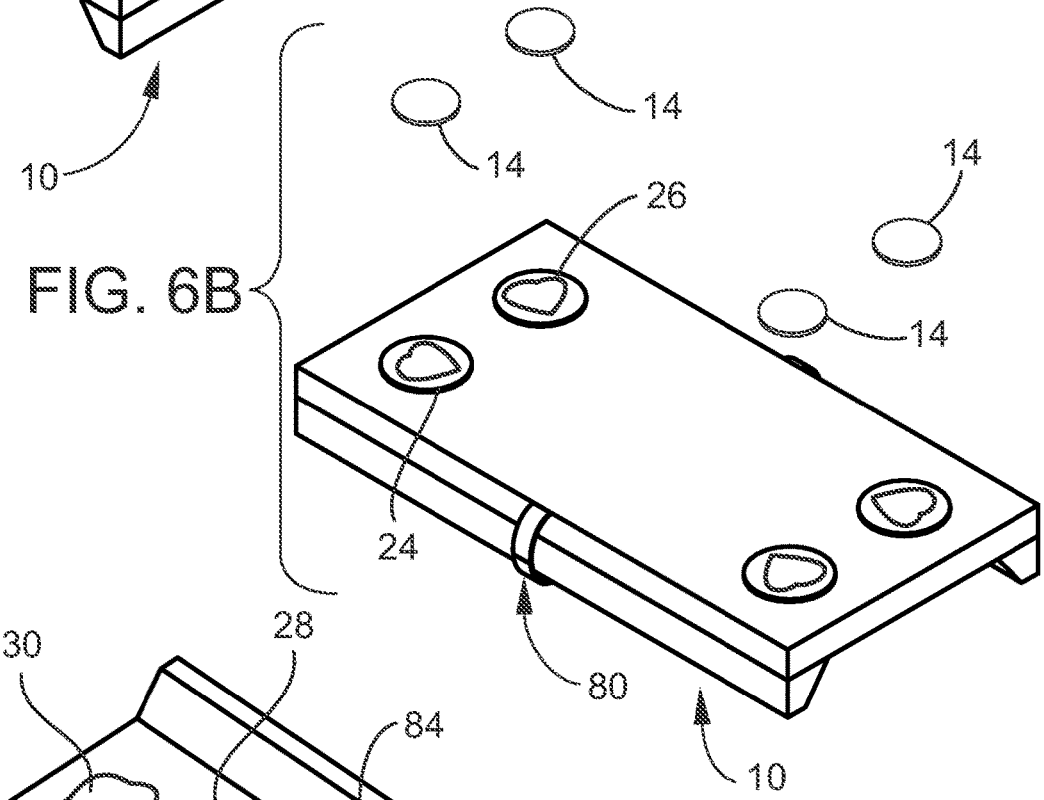
FIG. 6B is an exploded perspective view of the upside down changing pad of FIG. 6A.
Figure 6C:
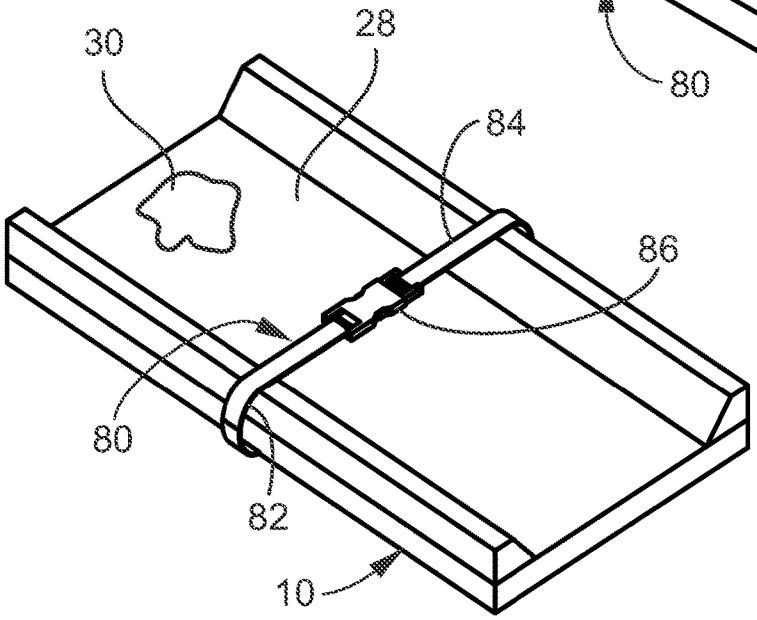
FIG. 6C is a perspective view of the baby changing pad of FIG. 6A in the right side up position.

FIGS. 6A, 6B, and 6C show the baby changing pad apparatus 10 having a set of four locators 14, a set of four non-skid grips 24, and a set of four locator receivers 26. Non-skid grips 24 are engaged, such as by stitching, to a flexible fabric cover 28 that is tailored to hug a resilient foam base 30. Each of the locator receivers 26 is engaged, such as by stitching, to its respective non-skid grip 24.

Figure 7A:
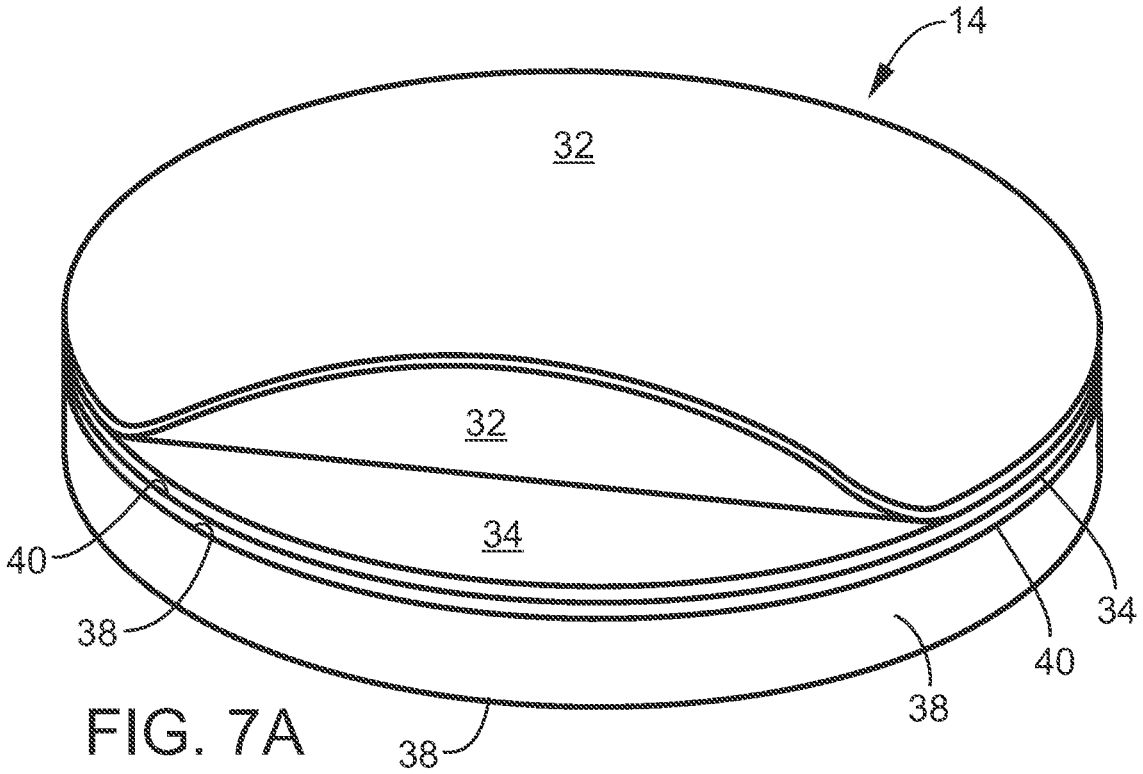
FIG. 7A is a detail perspective view of the locator of FIG. 6B, where the locator and its layers are not drawn to scale.
Figure 7B:
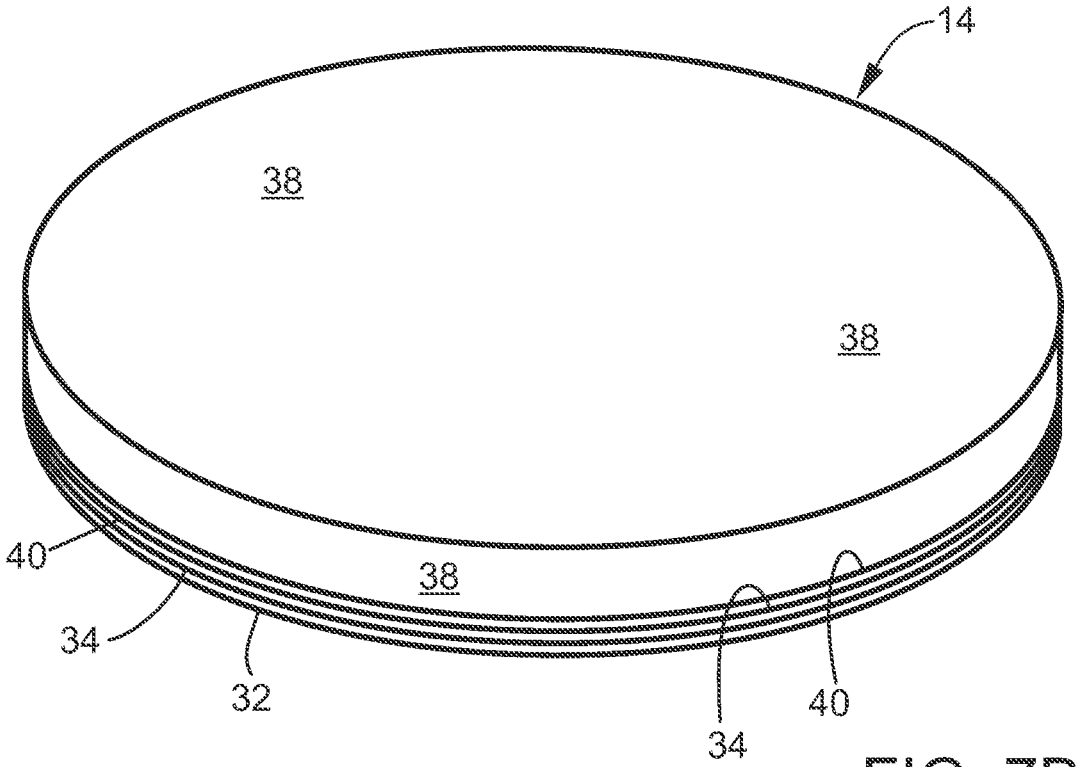
FIG. 7B is a detail perspective view of the locator of FIG. 6B showing the opposite side of the locator of FIG. 7A, where the locator and its layers are not drawn to scale.

FIG. 6A shows the state in which the baby changing pad apparatus 10 is purchased. In this state the locators 14 are engaged to the locator receivers 26. After purchase and just prior to placement on first table 12, a liner 32 or release 32, shown in FIGS. 7A, 7B, is pulled off to expose an adhesive layer 34. Then the baby changing apparatus 10 is placed right side up on the table 12 and pressed upon the table 12, with the caregiver 18 particularly pressing down on each of the four corner locations of the baby changing pad apparatus 10 so as to engage the adhesive layer 34 to the table top 16. Then the baby changing apparatus 10 may be lifted off the first table 12 to separate the locators 14 from the locator receivers 26.

Figure 10A:
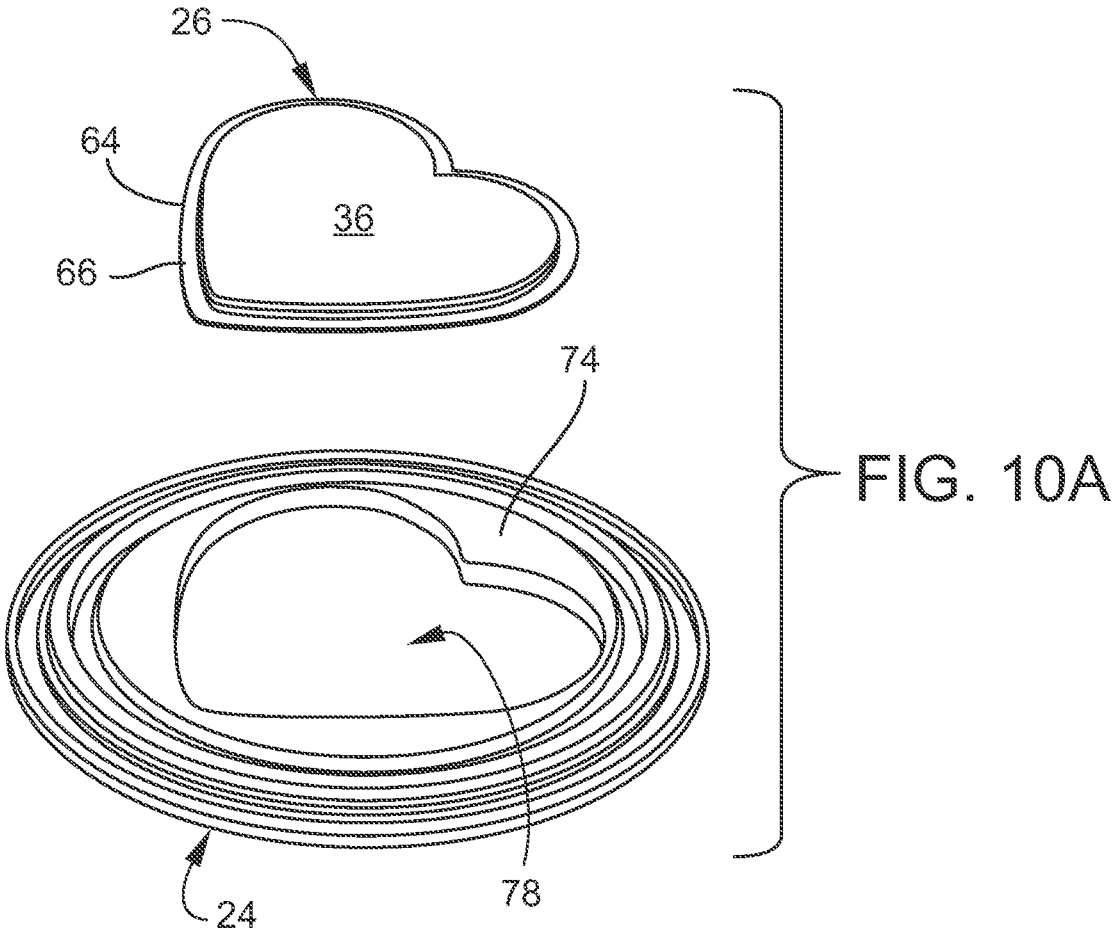
FIG. 10A is a perspective exploded view of the locator receiver and non-skid grip combination of the baby changing pad of FIG. 1.
Figure 10B:
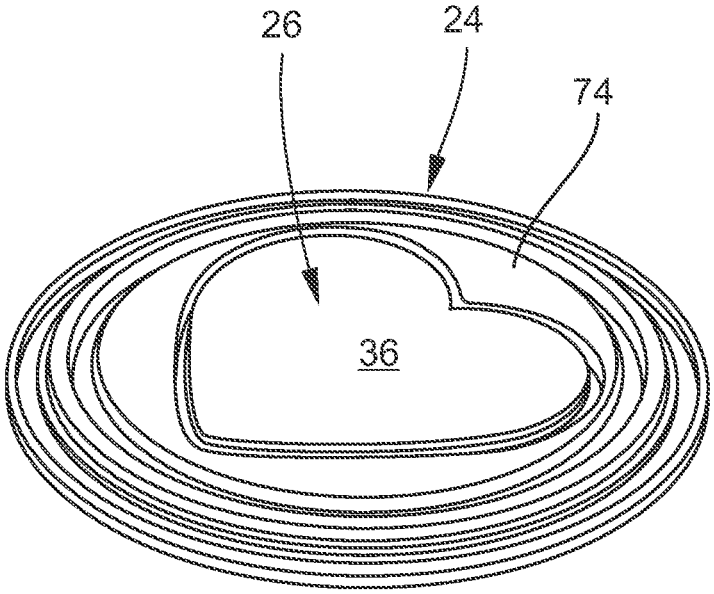
FIG. 10B is a perspective assembled view of the locator receiver and non-skid grip combination of the baby changing pad of FIG. 10A.
Figure 11A:
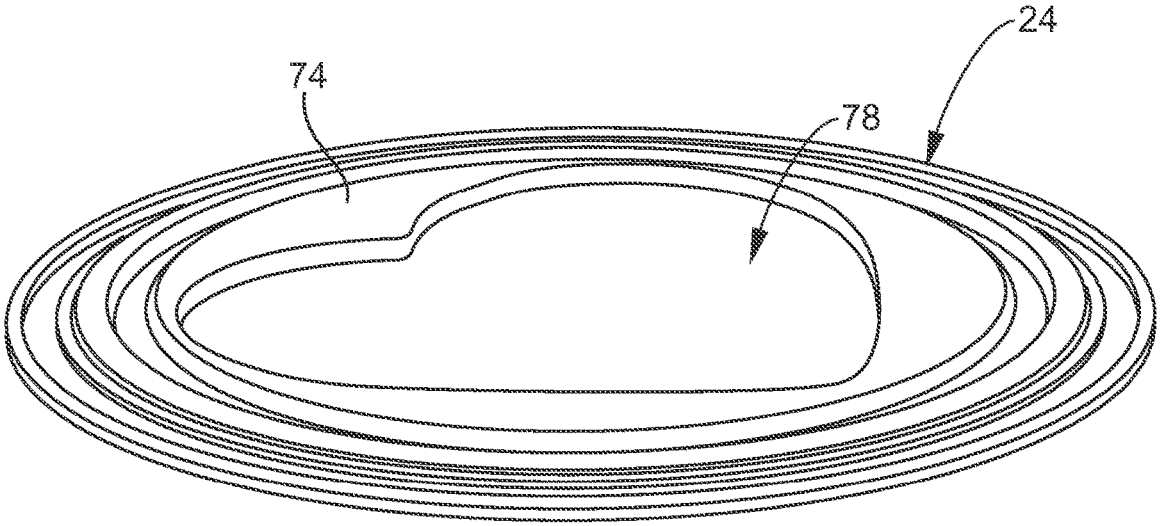
FIG. 11A is a perspective isolated view of the non-skid grip portion of the locator receiver and non-skid grip combination of FIG. 10A.
Figure 11B:
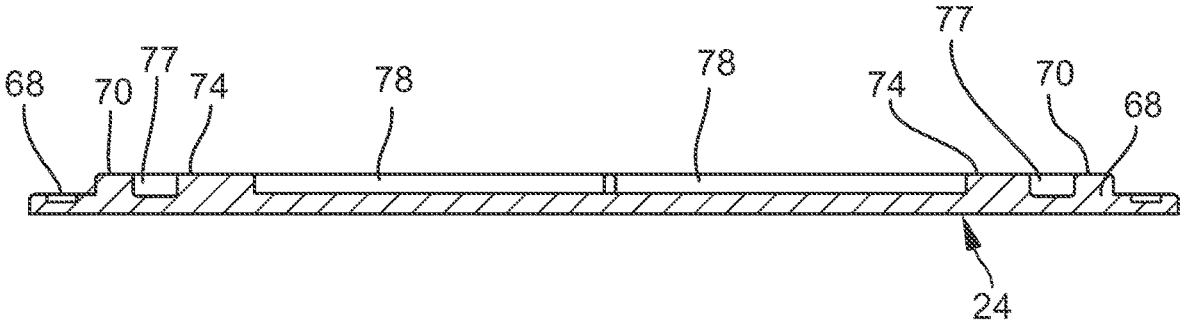
FIG. 11B is a section view of FIG. 11A.

Each of the locator receivers 26 includes a quick connect first portion 36 shown in FIGS. 10A and 10B and facing outwardly from the non-skid grip 24. This quick connect first portion 36 engages a quick connect second portion 38, shown in FIGS. 7A and 7B, found on the locator 14.

Besides the release layer 32, the adhesive layer 34, and the quick connect second portion layer 38, locator 14 includes a paper or plastic base layer 40 that is disposed between the quick connect second portion layer 38 and the adhesive layer 34.

Figure 15:
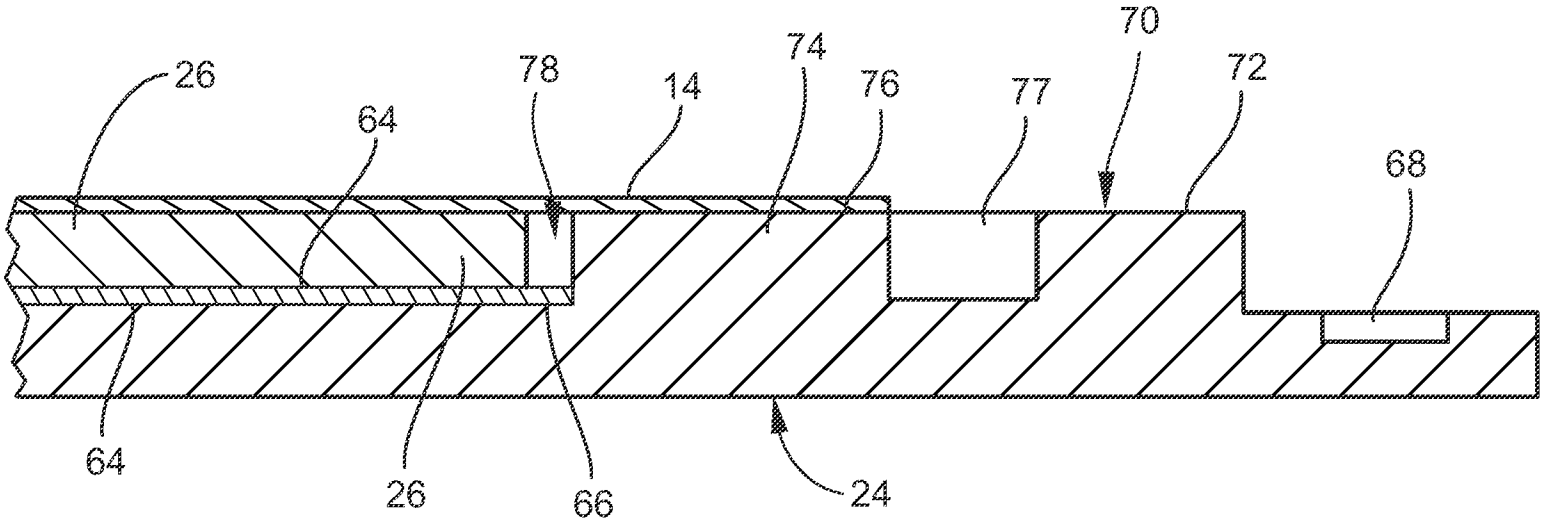
FIG. 15 is a detail view of a portion of FIG. 12B that shows the locator drawn to a greater degree of scale to show that lowermost grip portions of the non-skid grip engage a table or planar surface at the same time that the locator is engaged to the locator receiver.

The uppermost surface of the quick connect second portion layer 38 defines a plane. Locator 14 may be one of hooks and loops. Locator 14 may be in tape form, where the tape includes an extremely low height. FIG. 15 shows a low height for the locator 14. The true height of locator 14 may be even less than the height shown in FIG. 15. Locator 14 may be a Velcro® tape having one of macroscopic hooks and macroscopic loops as layer 38. Locator 14 may be disposed in a plane. Locator 14 may define a plane. Locator 14 defines a relatively thin disk.

Figure 9A:
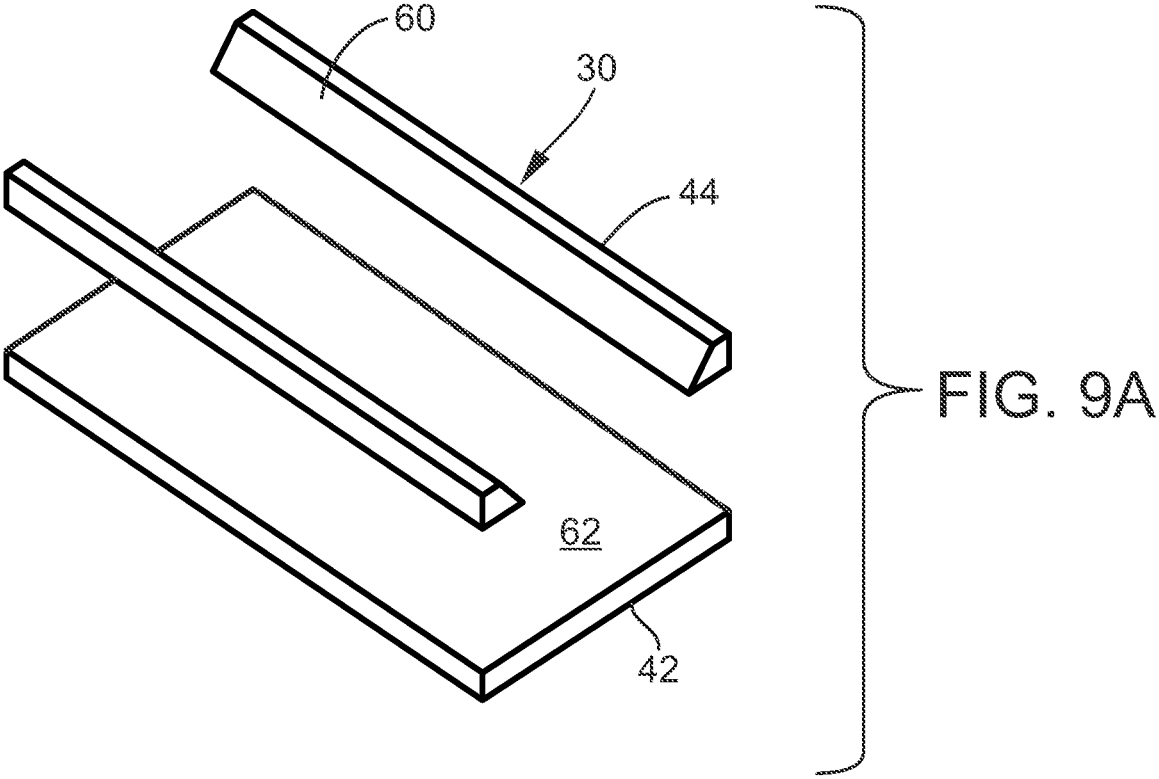
FIG. 9A is a perspective exploded view of the inside base of FIGS. 8A and 8B.
Figure 9B:
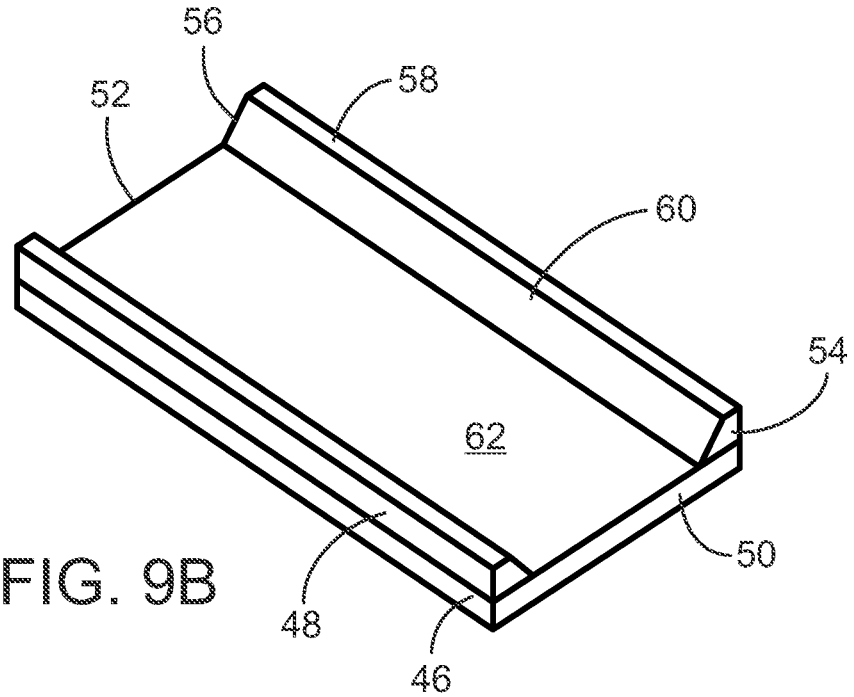
FIG. 9B is a perspective assembled view of the inside base of FIG. 9A having the sides glued onto a base portion.

As shown in FIG. 9A, the resilient base 30 of baby changing pad apparatus 10 includes a floor 42 in the form of a parallelepiped where lateral and longitudinal sections of the floor are rectangles having adjacent sides of unequal length. Floor 42 is a cuboid. Resilient base 30 further includes sides or barriers or rails or guards 44 engaged to the outer longer sides of the floor 42 such as by glueing. A first outer side face 46 of floor 42 is co-planar with a first outer side face 48 of guard 44. First and second end faces 50, 52 of the floor 42 are co-planar with first and second end faces 54, 56 of each of the guards 44. Each of the guards 44 includes an uppermost flat face 58 defining a plane. Each of the guards 44 includes a flat inner face 60 defining a plane that is oblique to an uppermost face 62 of floor 42. Uppermost face 62 defines a plane. A lateral section of guard 44 defines a trapezoid. Guards 44 are of equal longitudinal length and are further of equal longitudinal length of floor 42. Floor 42 and guards 44 are formed of a resilient material such as a foam. The foam may be a polyurethane foam. The foam or polyurethane foam may be a closed cell foam or an open cell foam.

Figure 8A:
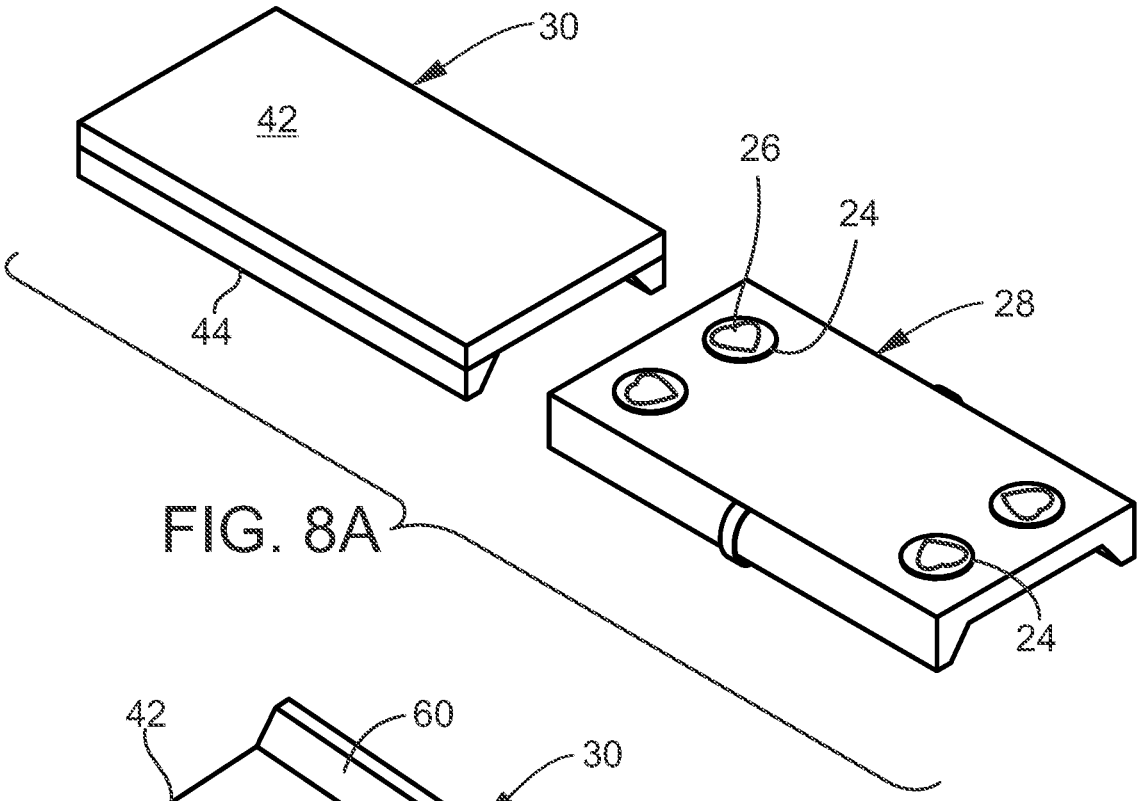
FIG. 8A is a perspective exploded upside down view of the inside base of the baby changing pad of FIG. 1 and the outside cover of the baby changing pad of FIG. 1, illustrating the cover hugs the base when engaged thereto.
Figure 8B:
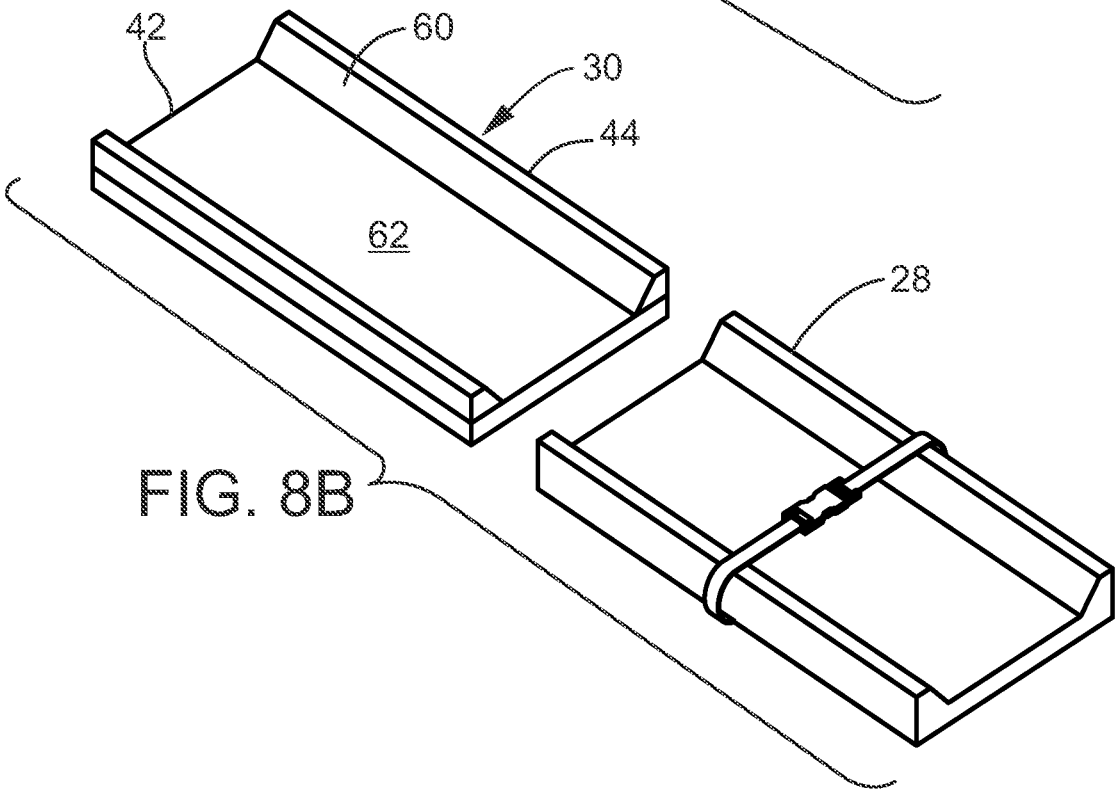
FIG. 8B is a perspective exploded right side up view of the inside base of the baby changing pad of FIG. 1 and the outside cover of the baby changing pad of FIG. 1, illustrating that the cover hugs the base when engaged thereto.

FIGS. 8A and 8B show that the cover 28 takes the same form or shape as the resilient base 30. Cover 28 encapsulates or envelopes the resilient base 30. Cover 28 hugs the resilient base 30. Cover 28 is tailored to take the form of the resilient base 30. Non-skid grip 24 is engaged to the cover 28 and is free of the resilient base 30. Locator receiver 26 is engaged to the non-skid grip 24 and is free of the resilient base 30. The inner faces of the cover 28 may include an adhesive that engages the outer faces of the resilient base 30 such that when baby changing pad apparatus 20 is lifted off the locators 14, the cover 28 does not separate from the resilient base 30. In other words, the inner faces of the cover 28 may include an adhesive that engages the outer faces of the resilient base 30 such that when baby changing pad apparatus 20 is lifted off the locators 14, portions of the cover 28 adjacent to the non-skid grip 24 and locator receivers 26 do not separate from portions of the resilient base 30 that are adjacent to the non-skid base 30 and locator receivers 26. The cover 28 may be polyester. Cover 28 and base 30 are essentially one-piece.

As shown in FIG. 10A, flexible locator receiver 26 includes a flexible base 64 of paper, plastic, or fabric. Base 64 runs across the entire underside of the flexible quick connect first portion 36. Base 64 is formed in the shape of a heart and is slightly larger than the quick connect first portion 36 that is also formed in the shape of a heart. The larger shape leaves a perimeter 66 that is engaged, such as by stitching, to the non-skid grip 24. FIG. 10B shows the locator receiver 26 engaged to the non-skid grip 24. FIG. 10B shows a locator receiver and non-skid grip combination.

Non-skid grip 24 has a number of concentric features or rings or channels. These concentric features or rings or channels are best shown in FIG. 15. Non-skid grip 24 includes a concentric channel 68 that may receive stitching for engaging the non-skid grip 24 to the cover 28. Within concentric channel 68 is a concentric ring 70 or ridge 70 with a flat or planar lowermost or outermost face 72. The concentric lowermost face 72 is the portion of the non-skid grip 24 that makes contact with a surface, such as table top 22 of second table 20. Relative to a smooth wooden table top, concentric lowermost face 72 has a high coefficient of friction. Non-skid grip 24, ring 70, and face 72 may be formed of a thermoplastic elastomer. Within concentric ring 70 is concentric ring 74 having a flat or planar lowermost or outermost face 76. When the baby changing pad apparatus 10 is first purchased, the release layer 32 is on the adhesive layer 34. When the release layer 32 is pulled off of the adhesive layer 34 and the locator 14 is to be engaged to a surface such as table top 16 of table 14, then a caregiver pushes upon the floor 42 of the baby changing pad apparatus 10 such that the concentric ring 74 and face 76 pushes upon the quick connect second portion layer 38, which pushes upon the paper or plastic base layer 40, which pushes upon the adhesive layer 34, which pushes upon a surface, such as table top 16 of first table 12. The diameter of the locator 14 is about equal to the outside diameter of the concentric ring 74, where the concentric ring 74 terminates at a concentric channel 77. There is no engagement between the quick connect second portion 38 or layer 38 and the ring 74 or lowermost surface 76. The concentric channel 77 between concentric rings 70 and 74 isolates the concentric rings 70, 74 from each other and provides for moisture, if present on a surface, to be received in the concentric channel 77. Within concentric ring 74 is a heart shaped depression 78 that receives the heart shaped locator receiver 26. The faces 72, 76 of concentric rings 70, 74 are co-planar. Faces 72, 76 of concentric rings 70, 74 are substantially co-planar with locator 14 when locator 14 is in a tape form such that the lowermost portion 72 of the non-skid grip 24 is adjacent to or abuts the first surface 16 a) when the quick connect first portion 36 is engaged to the quick connect second portion 38 and b) when the baby changing pad apparatus 10 is free of the quick connect second portion 38 such that the quick connect second portion 38 is not between the quick connect first portion 36 and the first surface 16. When no locator 14 is present between the locator receiver 26 and the table top 22, each of faces 72, 76 of rings 70, 74 abut or is adjacent to the table top 22.

Figure 12A:
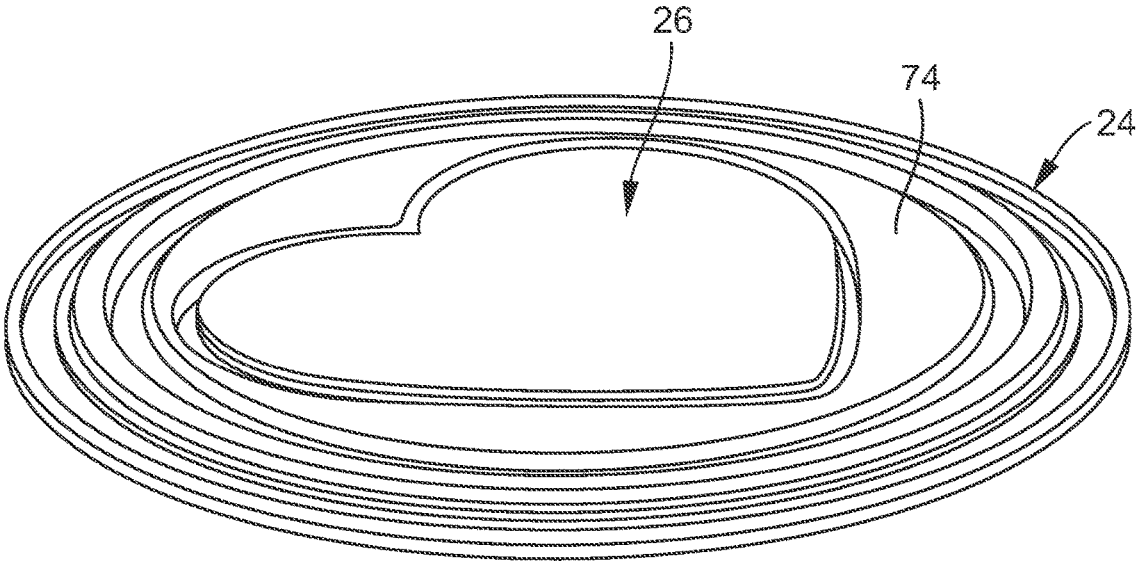
FIG. 12A is a perspective view of the locator receiver and non-skid grip combination of FIG. 10B, and shows a first embodiment of the combination where the engaging surface of the locator receiver is flush with the engaging surface of the non-skid grip.
Figure 12B:
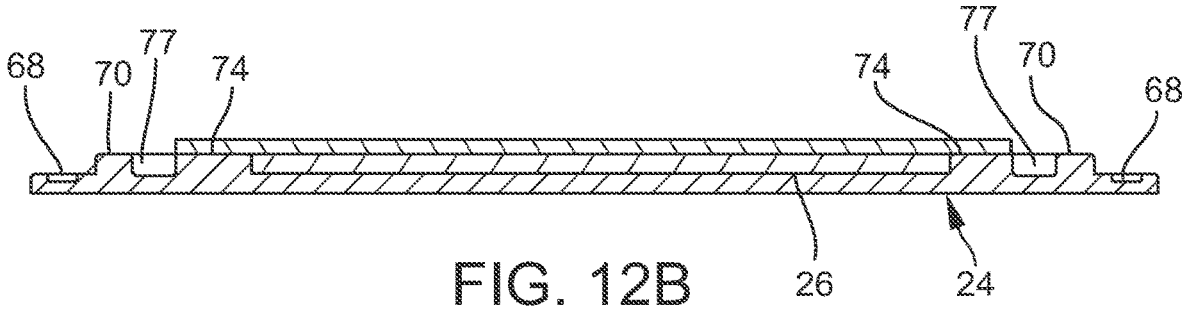
FIG. 12B is a detail section view of FIG. 12A and shows the first embodiment of the combination where the engaging surface of the locator receiver is flush with the engaging surface of the non-skid grip, and further shows the locator engaged to the locator receiver, but with the locator not drawn to scale.

FIGS. 12A and 12B show that the lowermost surface of the locator receiver 26 is co-planar with each of faces 72, 76 of rings 70, 74.

Figure 13A:
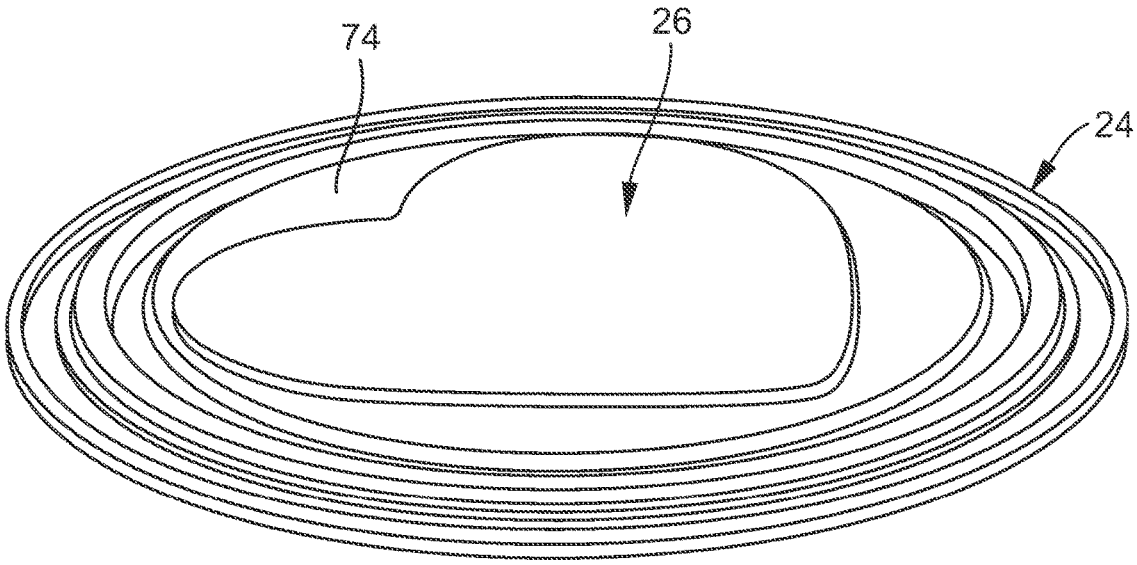
FIG. 13A is a perspective view of a second embodiment of the locator receiver and non-skid grip combination, where the engaging surface of the locator receiver extends beyond the engaging surface of the non-skid grip.
Figure 13B:
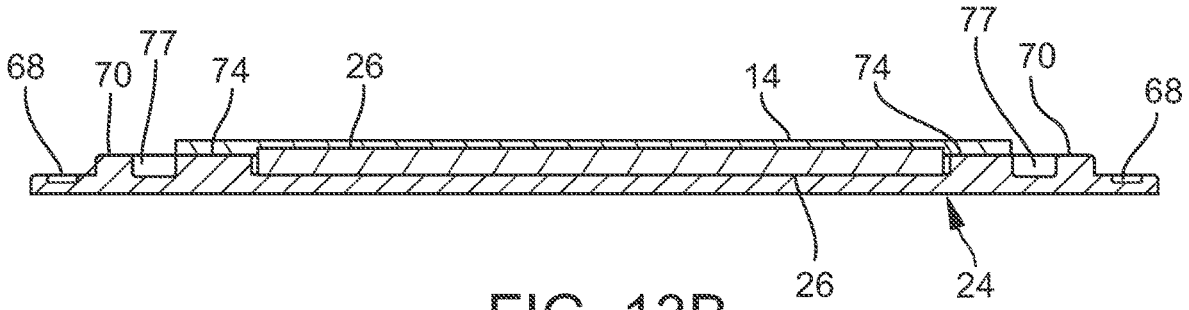
FIG. 13B is a detail section view of FIG. 13A and shows the second embodiment of the combination where the engaging surface of the locator receiver extends beyond the engaging surface of the non-skid grip, and further shows the locator engaged to the locator receiver, but with the locator not drawn to scale.

FIGS. 13A and 13B show that the lowermost surface of the locator receiver 26 defines a plane that is disposed outwardly of the plane defined by faces 72, 76 of rings 70, 74. This embodiment may be realized, for example, when the hook or loop portion of the locator receiver 26 is relatively hard and the hook or loop portion of the locator 14 is relatively soft. Or, for example, this embodiment may be realized when it is desirable to have the locator receiver 26 extend slightly out of the depression 78, whether the depression 78 is heart shaped or shaped in another form such as a disk. When the locator receiver 26 extends slightly out of the depression 78, then the undermost or lowermost surface of the locator receiver 26 is the undermost or lowermost surface of the entire baby changing pad apparatus 10, thereby making it more likely that the caretaker 18 can locate the locators 14 when placing the baby changing pad apparatus 10 on the table or surface having the locators 14. Even here, where the undermost or lowermost surface of the locator receiver 26 is lower than the non-skid face 72 of the non-skid ring 70, the flexible non-skid face 72 of the flexible non-skid ring 70 of the flexible non-skid grip 24 engages the table or selected surface under the weight of the baby changing pad apparatus 10 and under the weight of the baby. Further, the elevation difference between the undermost or lowermost surface of the quick connect first portion 36 and the non-skid concentric face 72 of the concentric ring 70 is only a slight difference, preferably less than ten millimeters, more preferably less than five millimeters, still more preferably less than four millimeters, yet more preferably less than three millimeters, and further more preferably less than two millimeters, where the undermost or lowermost surface of the quick connect first portion 36 has a lower elevation than the non-skid concentric face 72 of the concentric ring 70.

Figure 14A:
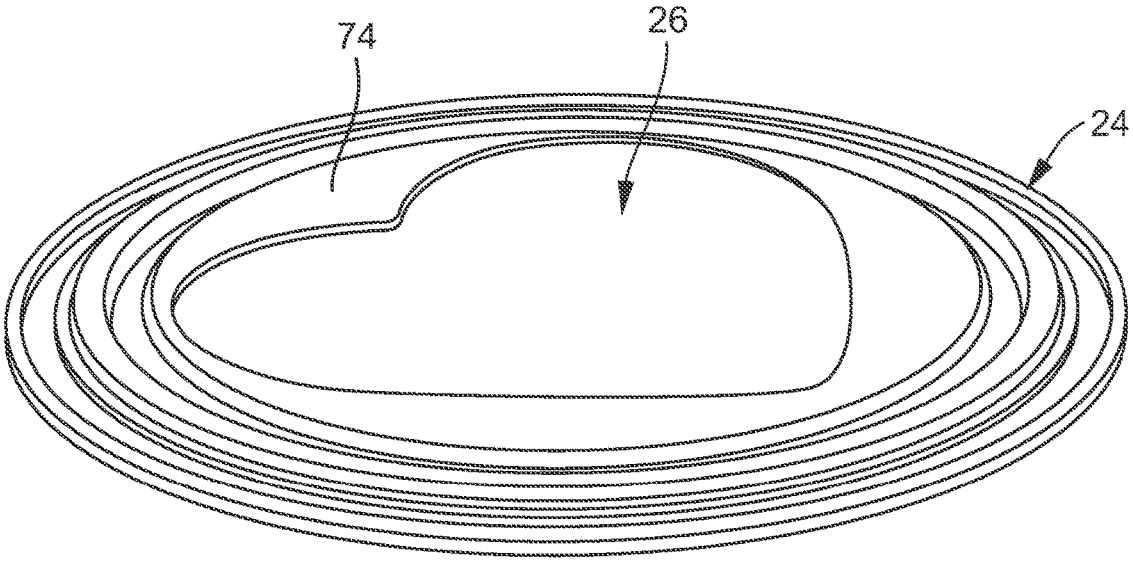
FIG. 14A is a perspective view of a third embodiment of the locator receiver and non-skid grip combination, where the engaging surface of the non-skid grip extends beyond the engaging surface of the locator receiver.
Figure 14B:
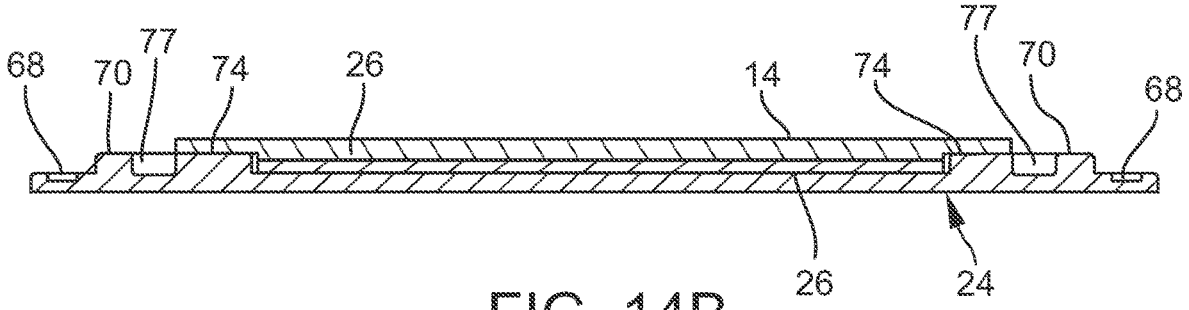
FIG. 14B is a detail section view of FIG. 14A and shows the third embodiment of the combination where the engaging surface of the non-skid grip extends beyond the engaging surface of the locator receiver, and further shows the locator engaged to the locator receiver but with the locator not drawn to scale.

FIGS. 14A and 14B show that the lowermost surface of the locator receiver 26 defines a plane that is disposed inwardly of the plane defined by faces 72, 76 of rings 70, 74. This embodiment may be realized when the hook or loop portion of the locator receiver 26 is relatively soft and the hook or loop portion of the locator 14 is relatively hard.

It should be noted that the non-skid grips 24, locators 14, and locator receivers 26 of FIGS. 12A, 12B, 13A, 13B, 14A, and 14B are shown in an upside down position. In use, these features have lowermost faces. For example, faces 72, 74 are lowermost faces of the non-slip grip 24.

As shown in FIGS. 6A, 6B, and 6C, baby changing pad apparatus 10 includes a strap 80 for keeping a baby secure on the floor 42 and between the guards 44. Strap 80 includes a first portion 82 and a second portion 84. The proximal ends of the strap portions 82, 84 are engaged to the cover 28 at a junction between the lowermost face of the cover 28 and side faces of the cover 28. Such junction is disposed intermediate of the opposing ends of the cover 28 to be centrally located on the baby changing pad apparatus 10. The distal ends of the strap portions 82, 84 are engagable to each other and disengagable from each other by a buckle 86. Buckle 86 is a quick connect and quick release buckle.

Non-skid grip 24 is formed of a first material having a relatively high coefficient of friction with a second material such as smooth wood, smooth glass, smooth plastic, smooth tile, smooth ceramics, smooth quartz, smooth stone, smooth porcelain, smooth vinyl, smooth enamel, smooth metal, smooth iron, and smooth steel. Such first material may be a rubber, an elastomer, a thermoplastic rubber, a thermoplastic elastomer, thermoset elastomer, synthetic rubber, recycled rubber, or a combination of two or more thereof. Such first material may be a material that is soft to the touch and not sticky to the touch. Non-skid grip 24 is preferably formed of a material having a coefficient of friction that a thermoplastic elastomer material having a shore hardness of 60 has on smooth wood.

Non-skid grip 24 is an elastomer and is preferably a thermoplastic elastomer or thermoplastic rubber. Such thermoplastic rubber or thermoplastic elastomer preferably has a shore hardness of 60 and may be referred to as having a TPR 60 hardness or a thermoplastic rubber 60 shore. Non-skid grip 24 may be a natural rubber or synthetic rubber or recycled rubber. Non-skid grip 24 may include block copolymers.

Non-skid grip 24 may or may not be sticky to the touch. Non-skid grip 24 is soft to the touch. Non-skid grip 24 is resilient and is resilient to a touch by a finger of a human hand.

In operation, the baby changing pad apparatus 10 is purchased in the state shown in FIG. 6A. The locator 14 is engaged to the locator receiver 26 with the release or liner 32 attached to the locator 14. The caregiver 18 then selects the table or surface where he or she will likely use the baby changing pad apparatus 10. Then the caregiver 18 removes the release or liner 32 from all four locators 14 and then sets the baby changing pad apparatus 10 in the right side up position on the selected table or surface with the adhesive layer 34 exposed on all four locators 14 such that the adhesive layer 34 adheres to the surface when the baby changing pad apparatus 10 is set right side up on the selected table or surface. Then the caregiver 18 can apply pressure on the four corner portions of the floor 42 so as to apply pressure upon the four non-skid grips 24, which applies pressure to the four locator receivers 26 and their respective four quick connect first portions 36, which applies pressure to the four quick connect second portions 38 of the locators 14, which applies pressure to the four adhesive layers 34 and the surface onto which the four adhesive layers 34 adhere. Then the caretaker 18 may remove the baby changing pad apparatus 10 from the table or surface, whereupon at such removal the quick connect first and second portions 36, 38 separate and the locators 14 remain on the table or surface. Subsequently, the baby changing apparatus 10 can remain on such table or selected surface or placed away on a shelf. If placed away on a shelf, the baby changing pad apparatus 10 can be carried back to the table or selected surface, whereupon by feel and/or by sight the caretaker 18 can engage the quick connect first and second portions 36, 38 with each other. Then the caretaker 18 can place the baby on the baby changing pad apparatus 10, strap the baby in, and change the baby. During the baby changing procedure, the first and second quick connect portions 36, 38 remain engaged to minimize or outright prevent movement of the baby changing pad apparatus 10 and further, the non-skid grips 24 and their non-skid concentric faces 72 of the concentric rings 70, under the weight of the baby changing pad apparatus 10 and under the weight of the baby, contribute to the engagement of the baby changing pad apparatus 10 to the table or selected surface. The non-skid concentric faces 72 of the concentric rings 70 contribute to such engagement where a) all four quick connect first and second portions 36, 38 have been fully engaged and b) one or more of the four quick connect first and second portions 36, 38 have been only partially engaged. In the case where none of the four quick connect first and second portions 36, 38 have been engaged, the non-skid grips 24 and the non-skid faces 72, 76 of the non-skid concentric rings 70, 74 take over such engagement so as to minimize or outright prevent movement of the baby changing pad apparatus 10. Also, even if only a portion of a non-skid concentric face 72 engages the table or surface, such as when a child leans in one direction or another, such non-skid face portion minimizes movement of the baby changing pad apparatus 10. Further, as shown by FIG. 3, the baby changing pad apparatus 10 may be used on a table or surface without the locators 14 and, in such a case, the non-skid grips 24 and the non-skid faces 72, 76 of the non-skid concentric rings 70, 74 engage the baby changing pad apparatus 10 to such table or surface to minimize or outright prevent movement of the baby changing pad apparatus 10 without the locators 14. It should be noted that if it is not desired to use the locators 14 or have them relatively permanently attached to a surface or table, the locators 14 can be removed from the baby changing pad apparatus 10 after purchase, whereupon the connectors for engaging the baby changing pad apparatus 10 to a table or surface are the non-skid grip concentric faces 72, 76 of the non-skid concentric rings 70, 74 of the non-skid concentric grips 24. It should further be noted that the adhesive 34 that is employed may be a pressure sensitive adhesive that is removable from surfaces, such as wood, glass, plastic, tile, ceramics, quartz, stone, porcelain, vinyl, enamel, metal, iron, and steel.

The quick connect first and second portions 36, 38 may include hooks and loops such as Velcro®, permanent or electric magnets, pressure sensitive or releasable tape, or mushroom head stem fasteners where there are about 250 mushroom-shaped head stems per square inch on each of the quick connect first portion 36 and quick connect second portion 38 where, when portions 36, 38 are pressed together, the stems flex and the mushroom heads slide past each other. One example of the mushroom-shaped head stem recloseable fastener is the 3M™ Dual Lock™. Hooks and loops and mushroom-shaped head stems may be referred to as barely macroscopic mechanical recloseable fasteners or almost microscopic mechanical recloseable fasteners or mechanical recloseable fasteners not visible to the normal naked eye but visible under a hand held magnifying glass.

Figure 16A:
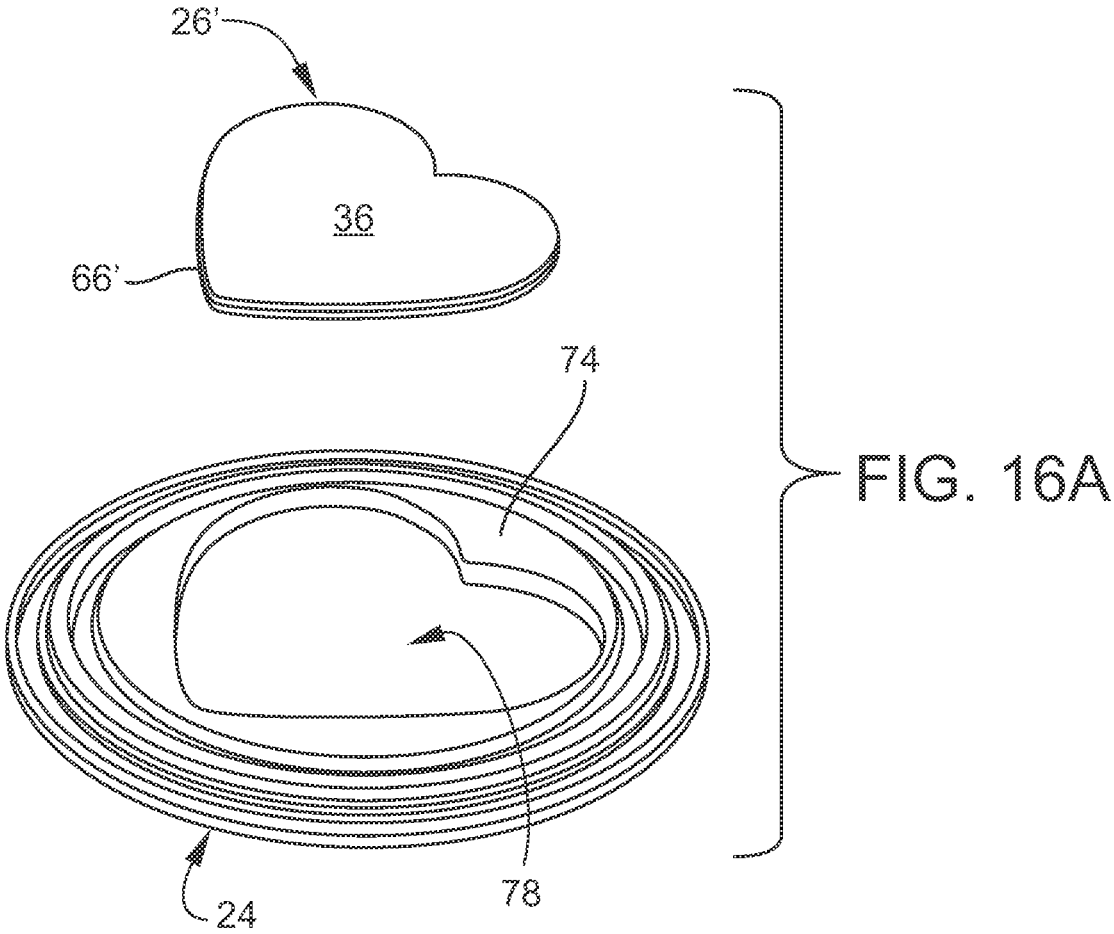
FIG. 16A is a perspective exploded view of a locator receiver and non-skid grip combination of another embodiment of the baby changing pad of FIG. 1.
Figure 16B:
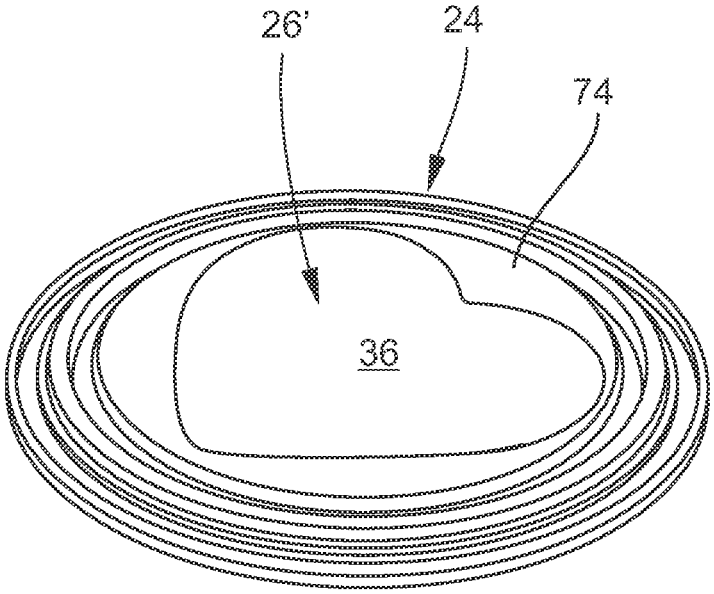
FIG. 16B is a perspective assembled view of the locator receiver and non-skid grip combination of the baby changing pad of FIG. 16A.

FIGS. 16A and 16B show a slightly different embodiment of the locator receiver 26. In FIGS. 16A and 16B, a locator receiver 26' may or may not include a base 64. If the locator receiver 26' includes a base 64, then the base 64 terminates at a perimeter 66' of locator receiver 26'. In FIG. 10A, the locator receiver 26 includes a perimeter 66 as an outside edge of the base 64. In FIGS. 16A and 16B, perimeter 66' is an outside edge of the quick connect first portion 36. In FIGS. 10A and 10B, the outside edge of the quick connect first portion 36 is spaced from, adjacent to, and parallel to the upright edge of the depression 78. In FIGS. 16A and 16B, the outside edge of the quick connect first portion 36 is in an abutting relationship, is adjacent to, and parallel to the upright edge of the depression 78. The embodiment of FIGS. 16A and 16B provides more surface area of the quick connect first portion 36 for engagement to the quick connect second portion 38. In FIGS. 16A and 16B, quick connect first portion 36 defines a first plane, face 76 of ring 74 defines a second plane, and such first and second planes are co-planar. Locator receiver 26' is engaged in depression 78 such as by being stitched therein or glued therein.

The adhesive layer 34 of locator 14 has a greater strength than the binding strength between first and second quick connect portions 36, 38 such that when the baby changing pad 10 is removed from a surface, such as table 12, the locators 14 remain on the table and the quick connect first portions 36 remain on the locator receiver 26.

The guards 44 on the baby changing pad 10 may be endless. In other words, guards 44 may be added to the ends that have the end faces 50, 52.

When the baby changing pad 10 is on a table having a true horizontal surface, the bottom face 42 of the base 30 lies at a greater altitude than does the bottom face of the fabric cover 28, which lies at a greater altitude than does the bottom face of the generally disk shaped non-skid grip 24, which lies at a greater altitude than the co-planar faces 72, 74 of the respective rings 70, 74, which lie at generally the same altitude as the lowermost portions of the quick connect first portion 36, which lie at generally the same altitude as the uppermost portions of the quick connect second portion 38, which lie at a greater altitude than the adhesive layer 34. When the quick connect first and second portions 36, 38 are composed of fibers, such as the hooks and loops of Velcro®, then some fiber portions will intermix and protrude beyond the planes defined by such lowermost portions and uppermost portions.

Where the first and second quick connect portions 36, 38 are Velcro® material or the 3M™ Dual Lock™ material, such material extends over the entire lower face of the locator receiver 26 or 26' and over the entire upper face of the locator 14 so as to maximize the engagement between the first and second quick connect portions 36, 38.

As to Velcro® material, the Mestral U.S. Pat. No. 3,009,235 issued Nov. 21, 1961 and entitled Separable Fastening Device is hereby incorporated by reference in its entirety. Further as to Velcro® material, the Billarant U.S. Pat. No. 3,417,440 issued Dec. 24, 1968 and entitled Hook And Loop Fastener is hereby incorporated by reference in its entirety. As to the 3M™ Dual Lock™ material, the Melbye et al. U.S. Pat. No. 7,188,396 issued Mar. 13, 2007 and entitled Method For Making A Mushroom-Type Hook Strip For A Mechanical Fastener is hereby incorporated by reference in its entirety.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A baby changing pad apparatus having a locator, locator receiver, and non-skid grip combination, the baby changing pad apparatus engagable to a first surface, the baby changing pad apparatus comprising:

a) a baby changing pad having an underside;

b) a non-skid grip engaged to the underside and facing away from the baby changing pad;

c) a locator receiver comprising a quick connect first portion engaged to the underside and facing away from the baby changing pad;

d) a locator comprising a quick connect second portion having first and second opposing sides, the first side engagable to and disengagable from the quick connect first portion, and the second side being engagable to the first surface such that the baby changing pad is engagable to the first surface; and e) wherein one of the quick connect first and second portions comprises hooks and wherein the other of the quick connect first and second portions comprises loops.

2. The baby changing pad apparatus of claim 1, wherein an outer surface of the non-skid grip defines a first plane, wherein an outer surface of the quick connect first portion defines a second plane, and wherein the first and second planes are generally co-planar.

3. The baby changing pad apparatus of claim 1, wherein an outer surface of the non-skid grip defines a first plane, wherein an outer surface of the quick connect first portion defines a second plane, wherein the first and second planes are parallel to each other, and wherein the first and second planes are offset from each other.

4. The baby changing pad apparatus of claim 1, wherein an outer surface of the non-skid grip defines a first plane, wherein an outer surface of the quick connect first portion defines a second plane, wherein the first and second planes are parallel to each other, and wherein the second plane is outwardly of the first plane.

5. The baby changing pad apparatus of claim 1, wherein an outer surface of the non-skid grip defines a first plane, wherein an outer surface of the quick connect first portion defines a second plane, wherein the first and second planes are parallel to each other, and wherein the first plane is outwardly of the second plane.

6. The baby changing pad apparatus of claim 1, wherein the non-skid grip comprises a rubber material.

7. The baby changing pad apparatus of claim 1, wherein the non-skid grip is resilient.

8. The baby changing pad apparatus of claim 1, wherein the non-skid grip comprises an elastomer.

9. The baby changing pad apparatus of claim 1, wherein the non-skid grip comprises a thermoplastic elastomer.

10. The baby changing pad apparatus of claim 1, wherein the non-skid grip comprises a material that provides a non-skid grip on a material selected from the group of materials consisting of wood, glass, plastic, tile, ceramics, quartz, stone, porcelain, vinyl, enamel, metal, iron, and steel.

11. The baby changing pad apparatus of claim 1, wherein the non-skid grip surrounds the quick connect first portion.

12. The baby changing pad apparatus of claim 1, wherein the non-skid grip is adjacent to the quick connect first portion.

13. The baby changing pad apparatus of claim 1, wherein the quick connect first portion is disposed centrally of the non-skid grip.

14. The baby changing pad apparatus of claim 1, wherein the non-skid grip is adjacent to or abuts the first surface a) when the quick connect first portion is engaged to the quick connect second portion and b) when the baby changing pad apparatus is free of the quick connect second portion such that the quick connect second portion is not between the quick connect first portion and the first surface.

15. The baby changing pad apparatus of claim 1, wherein the baby changing pad comprises a resilient base and a flexible cover, wherein the non-skid grip and quick connect first portion is engaged to the flexible cover, and wherein the non-skid grip and quick connect first portion are free of the resilient base.

16. The baby changing pad apparatus of claim 1, wherein the baby changing pad comprises a resilient base and a flexible cover, wherein the non-skid grip is engaged to and abuts the flexible cover, and wherein the quick connect first portion is engaged to and abuts the non-skid grip.

17. A baby changing pad apparatus having a locator, locator receiver and non-skid grip combination, the baby changing pad apparatus engagable to a first surface, the baby changing pad apparatus comprising:

a) a baby changing pad having an underside;

b) a non-skid grip engaged to the underside and facing away from the baby changing pad, the non-skid grip comprising a thermoplastic elastomer, said material being disposed on a lowermost portion of the non-skid grip;

c) a locator receiver comprising a quick connect first portion engaged to the underside and facing away from the baby changing pad;

d) a locator comprising a quick connect second portion having first and second opposing sides, the first side engagable to and disengagable from the quick connect first portion, and the second side being engagable to the first surface such that the baby changing pad is engagable to the first surface; and e) wherein one of the quick connect first and second portions comprises hooks and wherein the other of the quick connect first and second portions comprises loops.

18. The baby changing pad apparatus of claim 17, wherein the lowermost portion of the non-skid grip is adjacent to or abuts the first surface a) when the quick connect first portion is engaged to the quick connect second portion and b) when the baby changing pad apparatus is free of the quick connect second portion such that the quick connect second portion is not between the quick connect first portion and the first surface.

19. The baby changing pad apparatus of claim 17, wherein the non-skid grip is resilient.

20. A baby changing pad apparatus having a locator, locator receiver, and non-skid grip combination, the baby changing pad apparatus engagable to a first surface, the baby changing pad apparatus comprising:

a) a baby changing pad having an underside;

b) a non-skid grip engaged to the underside and facing away from the baby changing pad;

c) a locator receiver comprising a quick connect first portion engaged to the underside and facing away from the baby changing pad;

d) a locator comprising a quick connect second portion having first and second opposing sides, the first side engagable to and disengagable from the quick connect first portion, and the second side being engagable to the first surface such that the baby changing pad is engagable to the first surface; and e) wherein the baby changing pad comprises a resilient base and a flexible cover, wherein the non-skid grip and quick connect first portion is engaged to the flexible cover, and wherein the non-skid grip and quick connect first portion are free of the resilient base.

* * * * *